US009560920B2

(12) United States Patent
Oakes

(10) Patent No.: US 9,560,920 B2
(45) Date of Patent: Feb. 7, 2017

(54) FORWARD ADVANCING CUTLERY DISPENSER

(71) Applicant: Dixie Consumer Products LLC, Atlanta, GA (US)

(72) Inventor: Shawn Allen Oakes, Ripon, WI (US)

(73) Assignee: DIXIE CONSUMER PRODUCTS LLC, Atlanta, GA (US)

( * ) Notice: Subject to any disclaimer, the term of this patent is extended or adjusted under 35 U.S.C. 154(b) by 121 days.

(21) Appl. No.: 14/454,398

(22) Filed: Aug. 7, 2014

(65) Prior Publication Data

US 2015/0289679 A1 Oct. 15, 2015

Related U.S. Application Data

(60) Provisional application No. 61/978,425, filed on Apr. 11, 2014.

(51) Int. Cl.
*A47F 1/12* (2006.01)

(52) U.S. Cl.
CPC ..... *A47F 1/125* (2013.01)

(58) Field of Classification Search
CPC ..... A47F 2001/103; A47F 1/125; A47F 1/126
USPC ..... 221/279
See application file for complete search history.

(56) References Cited

U.S. PATENT DOCUMENTS

| | | | |
|---|---|---|---|
| 46,832 | A | 3/1865 | Thorne |
| 592,105 | A | 10/1897 | Barnes |
| D32,913 | S | 7/1900 | Graf |
| 703,718 | A | 7/1902 | Cammann |
| 716,058 | A | 12/1902 | Lang et al. |
| 925,485 | A | 6/1909 | Lafler |
| 999,837 | A | 8/1911 | Morris et al. |
| 1,053,387 | A | 2/1913 | Hawley |
| 1,146,447 | A | 7/1915 | Prommel |
| 1,182,793 | A | 5/1916 | Richardson |
| 1,259,927 | A | 3/1918 | Swift |
| 1,261,835 | A | 4/1918 | Martin |
| 1,353,109 | A | 9/1920 | Carr |
| 1,355,583 | A | 10/1920 | Zeidler et al. |
| 1,482,071 | A | 1/1924 | Duff et al. |
| 1,497,585 | A | 6/1924 | Poole |
| 1,504,098 | A | 8/1924 | Cathey |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

International Searching Authority, "International Search Report and Written Opinion for PCT/US2014/047463", mailed Nov. 26, 2014, 22 pages, Korean Intellectual Property Office, South Korea.

(Continued)

*Primary Examiner* — Patrick Mackey

(57) ABSTRACT

The present application provides a cutlery dispenser for dispensing a number of cutlery utensils. The cutlery dispenser may include a housing, a front cover enclosing the housing, a dispensing wedge, and a dispensing trough positioned on the front cover. The dispensing wedge angles a leading cutlery utensil into the dispensing trough for dispensing therethrough.

17 Claims, 11 Drawing Sheets

(56) References Cited

U.S. PATENT DOCUMENTS 1,546,077 A 7/1925 Hunter et al.
1,547,151 A 7/1925 Watling
1,560,938 A 11/1925 Lund
1,577,302 A 3/1926 Schultz
1,610,001 A 12/1926 Foster
1,635,386 A 7/1927 Pierson
1,675,510 A 7/1928 Nolan
1,767,634 A 6/1930 Weiss
1,821,377 A 3/1931 Cusick
1,886,378 A 11/1932 George
1,936,057 A 11/1933 Hodge
2,052,505 A 8/1936 Vetrosky
2,053,828 A 9/1936 Harper
2,078,984 A 5/1937 Williamson
2,089,378 A 8/1937 Jenkin
2,110,189 A 3/1938 Zeidler
2,141,684 A * 12/1938 Diemer ..... A47F 1/10 221/239
2,149,098 A 2/1939 Phinney
2,149,099 A 2/1939 Phinney et al.
2,160,374 A 5/1939 Veillette
2,184,029 A 12/1939 Wicklund
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,596 A 1/1942 Jerum
2,268,873 A * 1/1942 Hopkins ..... A47F 1/10 221/242
2,328,486 A 8/1943 Painter
2,340,561 A 2/1944 Renfro
2,497,718 A 1/1945 Earley et al.
2,401,534 A 6/1946 Welch
2,421,782 A * 6/1947 Gibbs ..... A47G 21/14 206/561
2,427,321 A 9/1947 Casey et al.
2,431,121 A 11/1947 Hunter
2,433,736 A 12/1947 Carew
2,445,026 A 7/1948 Frank
2,472,051 A 5/1949 Testi
2,503,741 A 4/1950 Johnson
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,965,262 A 9/1955 Du Bois
2,752,678 A 7/1956 Welch
2,771,214 A 11/1956 Lefebvre
2,800,013 A 7/1957 George
2,806,634 A 9/1957 Baumgartner
2,824,369 A 2/1958 Welch
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Hawie
2,877,490 A 3/1959 Greninger
2,877,926 A 3/1959 Abbe
2,880,907 A 4/1959 Mainers
2,881,247 A 4/1959 Levine et al.
2,889,076 A 6/1959 Van Schie
2,907,512 A 10/1959 Leone
2,911,127 A 11/1959 Driss et al.
2,924,357 A 2/1960 Kingsley et al.
2,946,431 A 7/1960 Nissen
2,946,481 A 7/1960 Carew
2,953,170 A 9/1960 Bush
2,954,948 A 10/1960 Johnson
3,021,919 A 2/1962 Peters
3,037,257 A 6/1962 Girodet
3,052,006 A 9/1962 Jonas
3,083,879 A 4/1963 Coleman
3,095,114 A 6/1963 Tobias
3,100,842 A 8/1963 Tellefsen
3,114,475 A 12/1963 Etes
3,115,989 A 12/1963 Strang
3,116,152 A 12/1963 Smith
3,132,765 A 5/1964 Florendo
3,146,908 A 9/1964 Perri et al.
3,163,327 A 12/1964 Maxwell
3,180,489 A 4/1965 McGinn
3,182,345 A 5/1965 Smith
3,191,802 A 6/1965 Lasting
3,217,954 A 11/1965 Grant et al.
3,263,860 A 8/1966 Haas
3,279,652 A 10/1966 Willvonseder
3,300,087 A 1/1967 Kuypers
3,310,271 A 3/1967 King
3,313,452 A 4/1967 Katz
3,325,050 A 6/1967 Wanamaker
3,334,784 A 8/1967 Morrison
3,338,471 A 8/1967 De Good
3,371,821 A 3/1968 Abood et al.
3,383,018 A 5/1968 Grimsley
3,400,435 A 9/1968 Akesson-Rydin
3,402,441 A 9/1968 Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Albert
3,499,538 A 3/1970 Sherard
3,558,006 A 1/1971 Redmond et al.
3,583,625 A 6/1971 Gero
3,587,922 A 6/1971 Oriti
3,593,908 A 7/1971 Desmond et al.
3,654,396 A 4/1972 Biezeveld
3,680,736 A 8/1972 Wiessmann
3,709,403 A 1/1973 Harriman
3,710,535 A 1/1973 Walter
3,741,410 A 6/1973 Henschke et al.
3,747,803 A 7/1973 Zoepf et al.
3,747,833 A 7/1973 Robinson
3,749,234 A 7/1973 Gero
3,786,959 A 1/1974 Greb et al.
3,851,762 A 12/1974 Liblick
3,861,563 A 1/1975 Lisbin
3,862,702 A 1/1975 Johnson
3,881,599 A 5/1975 Flaherty
3,897,886 A 8/1975 Franklin
3,932,978 A 1/1976 Kinney
3,944,128 A 3/1976 Hogan et al.
3,972,118 A 8/1976 Richard
3,987,901 A 10/1976 Dullinger
3,998,238 A 12/1976 Nigro
4,005,801 A 2/1977 Musser et al.
4,043,203 A 8/1977 Montesi
4,048,915 A 9/1977 Martin
4,091,915 A 5/1978 Claasen
4,120,662 A 10/1978 Fosslien
4,134,519 A * 1/1979 Barnett ..... A47F 1/08 221/155
4,146,123 A 3/1979 Cottrell
4,172,520 A 10/1979 Gero
4,271,999 A 6/1981 Stravitz
4,288,003 A 9/1981 Fries
4,308,974 A 1/1982 Jones
4,317,284 A 3/1982 Prindle
4,382,514 A 5/1983 Williams et al.
4,387,831 A 6/1983 Mcnally
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.

(56) References Cited

U.S. PATENT DOCUMENTS

| | | | |
|---|---|---|---|
| D284,442 | S | 7/1986 | Chan |
| 4,601,386 | A | 7/1986 | Antonello |
| 4,610,087 | A | 9/1986 | Mickelson et al. |
| 4,614,004 | A | 9/1986 | Oshida |
| 4,624,616 | A | 11/1986 | Freese et al. |
| 4,638,921 | A | 1/1987 | Sigl et al. |
| 4,658,984 | A | 4/1987 | Brunner |
| 4,662,536 | A | 5/1987 | Powers |
| 4,666,037 | A | 5/1987 | Weissman et al. |
| 4,666,060 | A | 5/1987 | Bouldin |
| 4,691,811 | A | 9/1987 | Arakawa et al. |
| 4,697,673 | A | 10/1987 | Omata |
| 4,707,251 | A | 11/1987 | Jenkins et al. |
| 4,715,514 | A | 12/1987 | Vidondo |
| 4,789,064 | A | 12/1988 | Segal |
| 4,793,539 | A | 12/1988 | Haenni et al. |
| 4,807,753 | A | 2/1989 | Goldstein |
| 4,835,864 | A | 6/1989 | Tang |
| 4,863,033 | A | 9/1989 | Buj |
| 4,884,718 | A | 12/1989 | Leahy |
| D305,709 | S | 1/1990 | Blignaut |
| 4,896,792 | A | 1/1990 | Marchand |
| 4,915,578 | A | 4/1990 | Becker |
| 4,921,106 | A | 5/1990 | Spatafora et al. |
| 4,950,120 | A | 8/1990 | Barnes |
| 4,961,684 | A | 10/1990 | Provan et al. |
| 4,963,072 | A | 10/1990 | Miley et al. |
| RE33,447 | E | 11/1990 | Rosman |
| 4,973,037 | A | 11/1990 | Holbrook |
| 4,986,442 | A | 1/1991 | Hinterreiter |
| 4,989,730 | A | 2/1991 | Lemoine et al. |
| 4,995,154 | A | 2/1991 | Bamber |
| 5,012,927 | A | 5/1991 | Borst et al. |
| D318,600 | S | 7/1991 | Lillelund et al. |
| 5,054,640 | A | 10/1991 | Tucker et al. |
| 5,054,649 | A | 10/1991 | Lemaire |
| 5,064,093 | A | 11/1991 | Davis et al. |
| 5,080,257 | A | 1/1992 | Carnisio |
| 5,127,546 | A | 7/1992 | Chen |
| 5,131,586 | A | 7/1992 | Capy |
| 5,156,266 | A | 10/1992 | Sykora et al. |
| 5,161,268 | A | 11/1992 | Harrow |
| 5,176,494 | A | 1/1993 | Nigrelli et al. |
| 5,191,997 | A | 3/1993 | Squitieri |
| 5,199,756 | A | 4/1993 | Bartlett et al. |
| 5,211,267 | A | 5/1993 | Clark |
| D336,047 | S | 6/1993 | Kim |
| 5,249,705 | A | 10/1993 | Gates |
| 5,263,596 | A | 11/1993 | Williams |
| D342,648 | S | 12/1993 | Cautereels et al. |
| 5,269,397 | A | 12/1993 | Kawamoto et al. |
| 5,288,361 | A | 2/1994 | Konno |
| 5,305,875 | A | 4/1994 | Meyer et al. |
| 5,325,992 | A | 7/1994 | Schmid et al. |
| 5,327,650 | A | 7/1994 | Rojas |
| D351,085 | S | 10/1994 | Schmidt |
| 5,353,935 | A | 10/1994 | Yeager et al. |
| 5,364,016 | A | 11/1994 | Capy et al. |
| 5,413,317 | A | 5/1995 | Spoerre |
| D362,160 | S | 9/1995 | Brabeck et al. |
| 5,449,054 | A | 9/1995 | Wiese et al. |
| 5,458,272 | A | 10/1995 | Ward-Weber |
| 5,460,252 | A | 10/1995 | Kosugi et al. |
| 5,469,688 | A | 11/1995 | Dunbar et al. |
| 5,479,708 | A | 1/1996 | Thomas |
| 5,497,863 | A | 3/1996 | Schmidt et al. |
| 5,509,522 | A | 4/1996 | Laidlaw |
| 5,518,149 | A | 5/1996 | Lotspeich et al. |
| 5,542,508 | A | 8/1996 | Van Erden et al. |
| 5,564,594 | A | 10/1996 | Monfredo |
| 5,579,910 | A | 12/1996 | Bennett |
| 5,586,685 | A | 12/1996 | Dorner et al. |
| 5,590,472 | A | 1/1997 | Yaakov |
| 5,605,208 | A | 2/1997 | Friedrichsen et al. |
| 5,660,252 | A | 8/1997 | Lafon |
| 5,762,211 | A | 6/1998 | Ensign |
| 5,845,403 | A | 12/1998 | Nivin |
| 5,853,092 | A | 12/1998 | Goodman et al. |
| 5,904,250 | A | 5/1999 | De Schutter |
| 5,921,408 | A | 7/1999 | Groenewold et al. |
| 5,933,918 | A | 8/1999 | Wallays |
| 5,950,842 | A | 9/1999 | Baur |
| 5,961,021 | A | 10/1999 | Koike et al. |
| D420,887 | S | 2/2000 | Chen |
| 6,021,919 | A | 2/2000 | Kelly |
| 6,023,908 | A | 2/2000 | Vetsch |
| 6,023,913 | A | 2/2000 | Gray et al. |
| D422,431 | S | 4/2000 | Goins |
| 6,047,830 | A | 4/2000 | Chang |
| 6,062,424 | A | 5/2000 | Simile-Gravina et al. |
| 6,073,795 | A | 6/2000 | Longstreth |
| 6,076,670 | A | 6/2000 | Yeranossian |
| 6,085,916 | A | 7/2000 | Kovacevic et al. |
| 6,098,379 | A | 8/2000 | Spatafora et al. |
| 6,115,921 | A | 9/2000 | Garneau |
| 6,134,790 | A | 10/2000 | Watson |
| 6,189,778 | B1 | 2/2001 | Kanter |
| 6,202,891 | B1 | 3/2001 | Mark |
| 6,226,845 | B1 | 5/2001 | Fink |
| 6,250,495 | B1 | 6/2001 | Bando |
| 6,250,498 | B1 * | 6/2001 | Lovejoy ..... A47F 1/04 221/185 |
| 6,257,443 | B1 | 7/2001 | LaCount |
| 6,289,889 | B1 | 9/2001 | Bell et al. |
| 6,298,960 | B1 | 10/2001 | Derr |
| 6,336,568 | B1 | 1/2002 | Tucker et al. |
| 6,378,729 | B1 | 4/2002 | Kodama |
| D458,070 | S | 6/2002 | Bennett et al. |
| 6,399,079 | B1 | 6/2002 | Mehta et al. |
| 6,412,398 | B1 | 7/2002 | Norcross et al. |
| 6,415,465 | B1 | 7/2002 | Harrow |
| 6,575,313 | B1 | 6/2003 | Chen |
| 6,626,633 | B2 | 9/2003 | Jendzurski et al. |
| 6,651,841 | B2 | 11/2003 | Tsuchida |
| 6,749,074 | B1 | 6/2004 | Hileman et al. |
| D492,549 | S | 7/2004 | Welch |
| D493,337 | S | 7/2004 | Welch |
| 6,763,972 | B2 | 7/2004 | Graupner |
| 6,786,357 | B2 | 9/2004 | Renard |
| 6,786,359 | B1 | 9/2004 | Schroeder |
| 6,832,694 | B2 | 12/2004 | Goeking |
| 6,832,698 | B1 | 12/2004 | Dybul |
| 6,837,028 | B1 | 1/2005 | Miano et al. |
| 6,840,353 | B2 | 1/2005 | Arisaka |
| 6,840,420 | B1 | 1/2005 | Hudson |
| 6,863,173 | B2 | 3/2005 | Bennett |
| 6,880,211 | B2 | 4/2005 | Jackson et al. |
| 6,895,672 | B2 | 5/2005 | Conforti |
| 6,923,365 | B2 | 8/2005 | Auclair et al. |
| 6,945,427 | B2 | 9/2005 | Hieb |
| 6,951,266 | B2 | 10/2005 | Tournier |
| 6,972,033 | B2 | 12/2005 | McNicholas |
| 6,976,348 | B1 | 12/2005 | Miano et al. |
| 7,013,568 | B2 | 3/2006 | Schmidt |
| 7,076,932 | B2 | 7/2006 | Rubin |
| 7,090,455 | B2 | 8/2006 | Lamb |
| 7,111,369 | B2 | 9/2006 | Ho |
| D533,034 | S | 12/2006 | Wasserman |
| 7,156,220 | B2 | 1/2007 | Olson et al. |
| D536,222 | S | 2/2007 | Heiberg et al. |
| 7,204,406 | B2 | 4/2007 | Bone et al. |
| 7,210,279 | B1 | 5/2007 | Ahmed et al. |
| 7,237,700 | B2 | 7/2007 | Bulovic |
| 7,249,793 | B1 | 7/2007 | Jabr et al. |
| 7,258,233 | B2 | 8/2007 | Lee et al. |
| 7,322,172 | B2 | 1/2008 | Hoffman et al. |
| D564,819 | S | 3/2008 | Fosburg et al. |
| 7,412,808 | B2 | 8/2008 | Lavi |
| 7,424,957 | B1 | 9/2008 | Luberto |
| D591,104 | S | 4/2009 | Oakes |
| 7,513,089 | B2 | 4/2009 | Rubin |
| 7,516,831 | B2 | 4/2009 | Chang |
| 7,520,247 | B2 | 4/2009 | Rutledge |
| 7,669,256 | B2 | 3/2010 | Harrow |

(56) References Cited

U.S. PATENT DOCUMENTS

| | | | | |
|---|---|---|---|---|
| 7,690,518 | B2 | 4/2010 | Fincher et al. | |
| 7,703,665 | B2 | 4/2010 | McGowan | |
| 7,716,842 | B2 | 5/2010 | Sumner-Trivisani et al. | |
| 7,731,899 | B2 | 6/2010 | Talmer et al. | |
| 7,819,234 | B2 | 10/2010 | Herzog | |
| 7,856,722 | B2 | 12/2010 | Lago-Arenas | |
| D631,337 | S | 1/2011 | Prevost | |
| 8,061,586 | B2 | 11/2011 | Fluegel et al. | |
| 8,070,013 | B2 * | 12/2011 | Reinsel | A47F 1/10 221/191 |
| 8,083,058 | B2 | 12/2011 | Marcinkowski et al. | |
| 8,083,097 | B2 | 12/2011 | Kaufman et al. | |
| 8,152,004 | B2 | 4/2012 | Smith et al. | |
| 8,210,364 | B2 * | 7/2012 | Smith | A47F 1/10 211/70.7 |
| 8,272,533 | B1 * | 9/2012 | D'Amelia | A47F 1/10 221/172 |
| 8,296,957 | B2 | 10/2012 | Muehlemann | |
| 8,297,473 | B2 | 10/2012 | Smith | |
| 8,302,269 | B2 | 11/2012 | Pitman | |
| 8,360,273 | B2 | 1/2013 | Reinsel et al. | |
| 8,444,006 | B2 | 5/2013 | Dixon | |
| 8,480,954 | B2 | 7/2013 | Talmer et al. | |
| D697,793 | S | 1/2014 | Levy et al. | |
| 8,662,345 | B1 | 3/2014 | Wang | |
| 8,776,379 | B2 | 7/2014 | Walters et al. | |
| 8,789,704 | B2 | 7/2014 | Nowak | |
| 8,839,522 | B2 | 9/2014 | Walters et al. | |
| 8,844,798 | B2 | 9/2014 | Linkel | |
| 9,198,465 | B2 | 12/2015 | Ghini et al. | |
| D772,514 | S | 11/2016 | Wang | |
| 2001/0007308 | A1 | 7/2001 | Glassman et al. | |
| 2001/0025856 | A1 | 10/2001 | Lefevre Du Grosriez et al. | |
| 2002/0112445 | A1 | 8/2002 | Scaduto | |
| 2003/0015824 | A1 | 1/2003 | Forbes et al. | |
| 2003/0098344 | A1 | 5/2003 | Blake et al. | |
| 2004/0045398 | A1 | 3/2004 | Hayashi | |
| 2004/0045860 | A1 | 3/2004 | Edgerly et al. | |
| 2004/0089670 | A1 | 5/2004 | Goeking et al. | |
| 2004/0237311 | A1 | 12/2004 | Brown et al. | |
| 2005/0035136 | A1 | 2/2005 | Dathe et al. | |
| 2005/0082307 | A1 | 4/2005 | Tucker | |
| 2005/0116482 | A1 | 6/2005 | Harris et al. | |
| 2005/0155186 | A1 | 7/2005 | McGuyer et al. | |
| 2005/0155229 | A1 | 7/2005 | Lee | |
| 2005/0211722 | A1 | 9/2005 | Runnels | |
| 2005/0252057 | A1 | 11/2005 | Lavi | |
| 2006/0000190 | A1 | 1/2006 | Behnke et al. | |
| 2006/0042986 | A1 | 3/2006 | Simkowski et al. | |
| 2006/0053638 | A1 | 3/2006 | Sumner-Trivisani et al. | |
| 2006/0218795 | A1 | 10/2006 | Santa Cruz et al. | |
| 2006/0249531 | A1 | 11/2006 | Litchfield et al. | |
| 2007/0035943 | A1 | 2/2007 | Wang | |
| 2007/0108141 | A1 | 5/2007 | Smith et al. | |
| 2007/0131705 | A1 | 6/2007 | Behravesh et al. | |
| 2007/0193968 | A1 | 8/2007 | Smith et al. | |
| 2007/0214650 | A1 | 9/2007 | Tomazini | |
| 2007/0250391 | A1 | 10/2007 | Prade et al. | |
| 2008/0118609 | A1 | 5/2008 | Harlfinger et al. | |
| 2008/0121650 | A1 | 5/2008 | Smith | |
| 2008/0128445 | A1 | 6/2008 | Huang et al. | |
| 2009/0194557 | A1 | 8/2009 | Van Deursen | |
| 2010/0084418 | A1 | 4/2010 | Reinsel et al. | |
| 2010/0147869 | A1 | 6/2010 | Iliffe et al. | |
| 2010/0170915 | A1 | 7/2010 | Reinsel et al. | |
| 2011/0180562 | A1 | 7/2011 | Reinsel et al. | |
| 2011/0226797 | A1 | 9/2011 | Reinsel et al. | |
| 2011/0296693 | A1 | 12/2011 | Oakes | |
| 2012/0036724 | A1 | 2/2012 | Walters | |
| 2012/0047744 | A1 | 3/2012 | Walters | |
| 2012/0080444 | A1 | 4/2012 | Smith et al. | |
| 2012/0110746 | A1 | 5/2012 | Serrano et al. | |
| 2012/0145734 | A1 | 6/2012 | Walters | |
| 2012/0145735 | A1 | 6/2012 | Erickson et al. | |
| 2012/0145736 | A1 | 6/2012 | Walters et al. | |
| 2013/0032609 | A1 | 2/2013 | Righetti et al. | |
| 2013/0043272 | A1 * | 2/2013 | Oakes | A47F 1/125 221/279 |
| 2013/0126548 | A1 | 5/2013 | Pourian et al. | |
| 2013/0134211 | A1 | 5/2013 | Linkel | |
| 2013/0152406 | A1 | 6/2013 | McFarland | |
| 2013/0193157 | A1 | 8/2013 | Jongen et al. | |
| 2014/0069930 | A1 | 3/2014 | Oakes | |
| 2014/0117036 | A1 | 5/2014 | Smith et al. | |
| 2014/0191024 | A1 | 7/2014 | Wnek et al. | |
| 2014/0217112 | A1 | 8/2014 | Young et al. | |
| 2014/0299656 | A1 | 10/2014 | Wintermute | |
| 2015/0028045 | A1 | 1/2015 | Oakes et al. | |
| 2015/0028046 | A1 | 1/2015 | Oakes et al. | |
| 2015/0041363 | A1 | 2/2015 | Freeman et al. | |
| 2015/0041484 | A1 | 2/2015 | Oakes | |
| 2015/0048108 | A1 | 2/2015 | Borke | |
| 2015/0265108 | A1 | 9/2015 | Brickl et al. | |

FOREIGN PATENT DOCUMENTS

| | | | |
|---|---|---|---|
| CN | 101495015 | A | 7/2009 |
| CN | 103919421 | A | 7/2014 |
| DE | 7033238 | U | 11/1970 |
| DE | 7127677 | | 11/1971 |
| DE | 3151268 | A1 | 7/1983 |
| DE | 4139938 | A1 | 6/1993 |
| DE | 202005013647 | U1 | 7/2006 |
| EP | 0257109 | A1 | 8/1986 |
| EP | 0286538 | A1 | 10/1988 |
| EP | 0856272 | A3 | 1/1999 |
| EP | 1022107 | A1 | 7/2000 |
| EP | 1217923 | B1 | 9/2003 |
| EP | 1358827 | A2 | 11/2003 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| FR | 2889507 | A1 | 2/2007 |
| JP | H06121727 | A | 5/1994 |
| JP | 08011934 | A | 1/1996 |
| JP | 08-047440 | | 2/1996 |
| JP | 3042582 | U | 10/1997 |
| JP | 2001354214 | A | 12/2001 |
| JP | 2004261336 | A | 9/2004 |
| JP | 2007319493 | A | 12/2007 |
| KR | 20-1991-0008085 | | 10/1991 |
| KR | 10-2009-0071515 | A | 7/2009 |
| KR | 100954569 | B1 | 4/2010 |
| TW | M287639 | U | 2/2006 |
| TW | M293720 | U | 7/2006 |
| WO | 2004028309 | A1 | 4/2004 |
| WO | 2007049982 | A1 | 5/2007 |
| WO | 2009137367 | A2 | 11/2009 |

OTHER PUBLICATIONS

International Searching Authority, "International Search Report and Written Opinion for PCT/US2014/050166", mailed Nov. 20, 2014, 11 pages, Korean Intellectual Property Office, South Korea.

International Searching Authority, "International Search Report and Written Opinion for PCT/US2014/050169", mailed Jan. 9, 2015, 11 pages, Korean Intellectual Property Office, South Korea.

International Searching Authority, "International Search Report and Written Opinion for PCT/US2014/051632", mailed Dec. 3, 2014, 9 pages, Korean Intellectual Property Office, South Korea.

International Searching Authority, "International Search Report and Written Opinion for PCT/US2014/051639", mailed Dec. 9, 2014, 9 pages, Korean Intellectual Property Office, South Korea.

Peel Adhesion for Single Coated Pressure-Sensitive Tapes 180 Angle, Aug. 1989, pp. 21-22.

Tack Rolling Ball, Aug. 1989, pp. 29-30.

Holding Power of Pressure-Sensitive Tape, Aug. 1989, pp. 31-33.

European Search Report for 060009258.2, mailed Jul. 24, 2006, five pages, Munich, Germany.

International Search Report and Written Opinion for PCT/US2011/044931, mailed Feb. 28, 2012.

(56) References Cited

OTHER PUBLICATIONS

International Search Report and Written Opinion for PCT/US2011/044934, mailed Mar. 6, 2012.
International Search Report and Written Opinion for PCT/US2011/064057, dated Feb. 29, 2012.
PCT International Search Report and Written Opinion PCT/US2007/083752, Mar. 11, 2008, 10 pages.
PCT International Search Report and Written Opinion PCT/US2007/083922 mailed Nov. 17, 2008, 10 pages.
Supplementary European Search Report for EP 11 79 3088 dated Sep. 25, 2013.
European Search Report for EP 08 014 387.8, mailed Nov. 11, 2008, four pages, European Patent Office, Munich, Germany.
International Search Report and Written Opinion for PCT/US2011/068329; dated Feb. 29, 2012.
International Search Report and Written Opinion for PCT/US2011/068767, dated Feb. 29, 2012.
International Search Report and Written Opinion for PCT/US2009/069916, mailed Feb. 3, 2010, 13 pages, European Patent Office, Munich, Germany.

* cited by examiner

FORWARD ADVANCING CUTLERY DISPENSER

FIELD OF THE DISCLOSURE

The present application and the resultant patent relate generally to dispensers for cutlery utensils and more particularly relate to a forward advancing cutlery dispenser for dispensing one utensil at a time in a controlled and hygienic manner with simplified components.

BACKGROUND

Restaurants and other types of retail outlets often provide cutlery utensils in open self-serve dispensing bins. Consumers may retrieve a fork, a spoon, a knife, a spork, and the like directly therefrom. Such open dispensing bins, however, may have at least the appearance of being somewhat unhygienic in that the cutlery utensils may not be enclosed or wrapped. Consumers may react negatively in that the remaining utensils thus may be touched or otherwise contacted while a selected utensil is being removed from the dispensing bin.

To address these concerns relating to the cutlery utensils, enclosed cutlery dispensers have been used. The cutlery utensils may be placed in a utensil compartment and may be dispensed one at a time on command. Generally described, these dispensers may operate via gravity or via a dispensing lever, a rotating belt, and/or other types of dispensing mechanisms. The mechanics of these dispensing mechanisms, however, may be complex and hence may be subject to malfunction. Further, these dispensers typically may be somewhat bulky and may occupy a significant footprint on an already crowded countertop and the like.

There is thus a desire for an improved dispenser for cutlery utensils and the like. Preferably such an improved dispenser may be easy and hygienic to load and to dispense the cutlery utensils therefrom with a reduced overall footprint and simplified dispensing mechanics.

SUMMARY

The present application and the resultant patent thus provide a cutlery dispenser for dispensing a number of cutlery utensils positioned within a stack. The cutlery dispenser may include a housing, a front cover enclosing the housing, a dispensing wedge, and a dispensing trough positioned on the front cover. The dispensing wedge angles a leading cutlery utensil into the dispensing trough for dispensing therethrough.

The present application and the resultant patent further provide a method of dispensing cutlery utensils from a dispenser. The method may include the steps of pushing a stack of cutlery utensils into the dispenser, holding the stack of cutlery utensils in place via a pair of flexors when a front cover of the dispenser is open, closing the front cover, releasing the pair of flexors when the front cover is closed, and pushing several of the cutlery utensils into a fanned position about the front cover.

The present application and the resultant patent further provide a cutlery dispenser. The cutlery dispenser may include a housing, a front cover enclosing the housing, a dispensing wedge positioned about the front cover, and a stack of cutlery utensils positioned within the housing. A number of the cutlery utensils may have a fanned position about the front cover.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
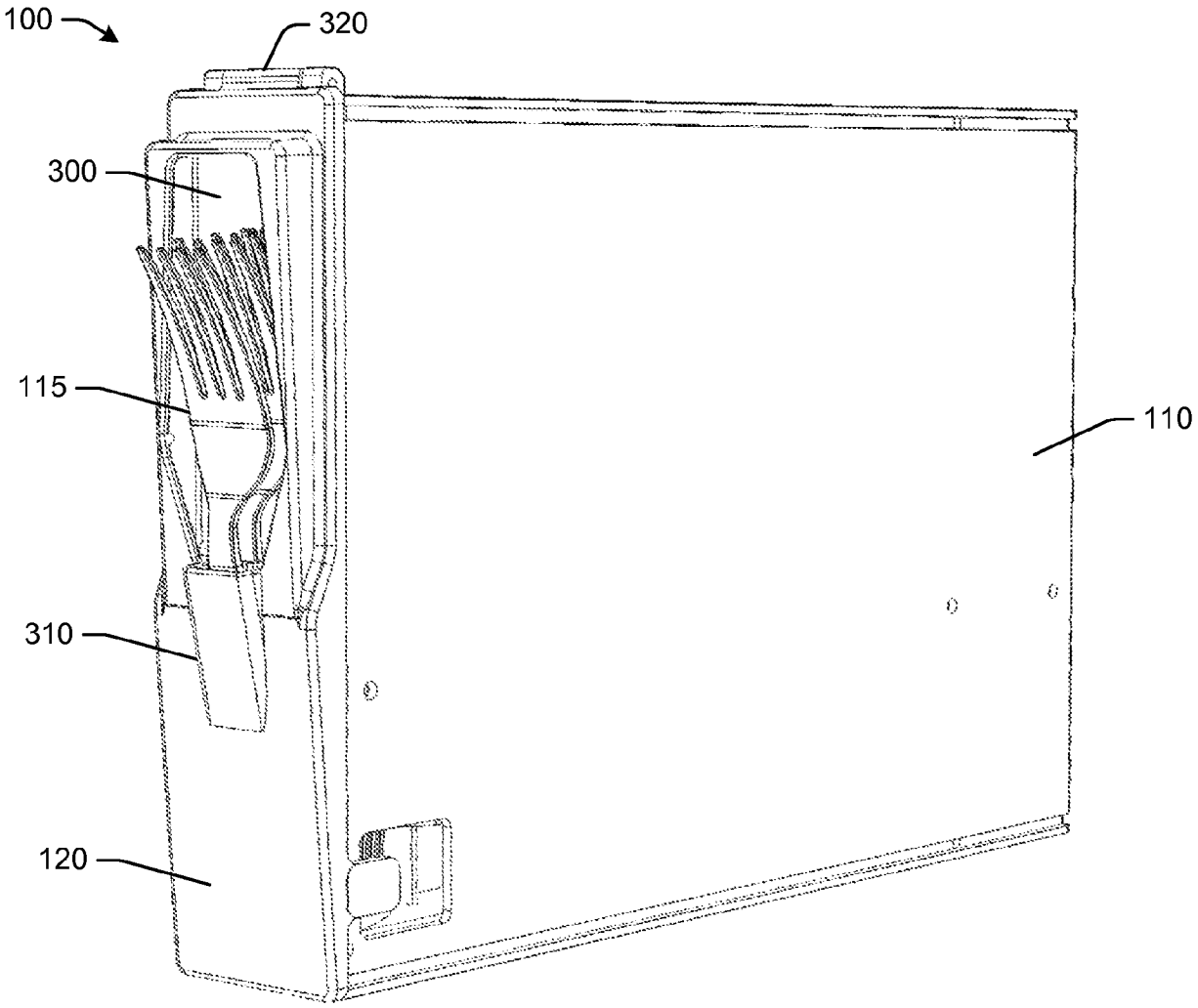
FIG. 1 is a perspective view of a cutlery dispenser as may be described herein.

Referring now to the drawings, in which like numerals refer to like elements throughout the several views, FIG. 1 shows an example of a cutlery dispenser 100 as may be described herein. The cutlery dispenser 100 may be used with a number of cutlery utensils 115. As will be described in more detail below, any number of the cutlery utensils 115 may be used herein in any suitable size, shape, or configuration. The cutlery utensils 115 may or may not be configured for specific use in the cutlery dispenser 100 described herein. Other types of items also may be dispensed from the cutlery dispenser 100.

The cutlery dispenser 100 may include a housing 110. The housing 110 may be enclosed by a front cover 120. The cutlery dispenser 100, and the components thereof, may have any suitable size, shape, or configuration. Specifically, the cutlery dispenser 100 and the components thereof, may be sized to accommodate the various types of cutlery utensils 115 for loading therein and for dispensing therefrom. The cutlery dispenser 100, and the components thereof, may be made out of any suitable type of substantially rigid material including thermoplastics such as polypropylene, metals such as aluminum, composite materials, and the like. Different types of materials may be used herein. The cutlery dispenser may be fixed and mounted or free standing and portable.

Figure 2:
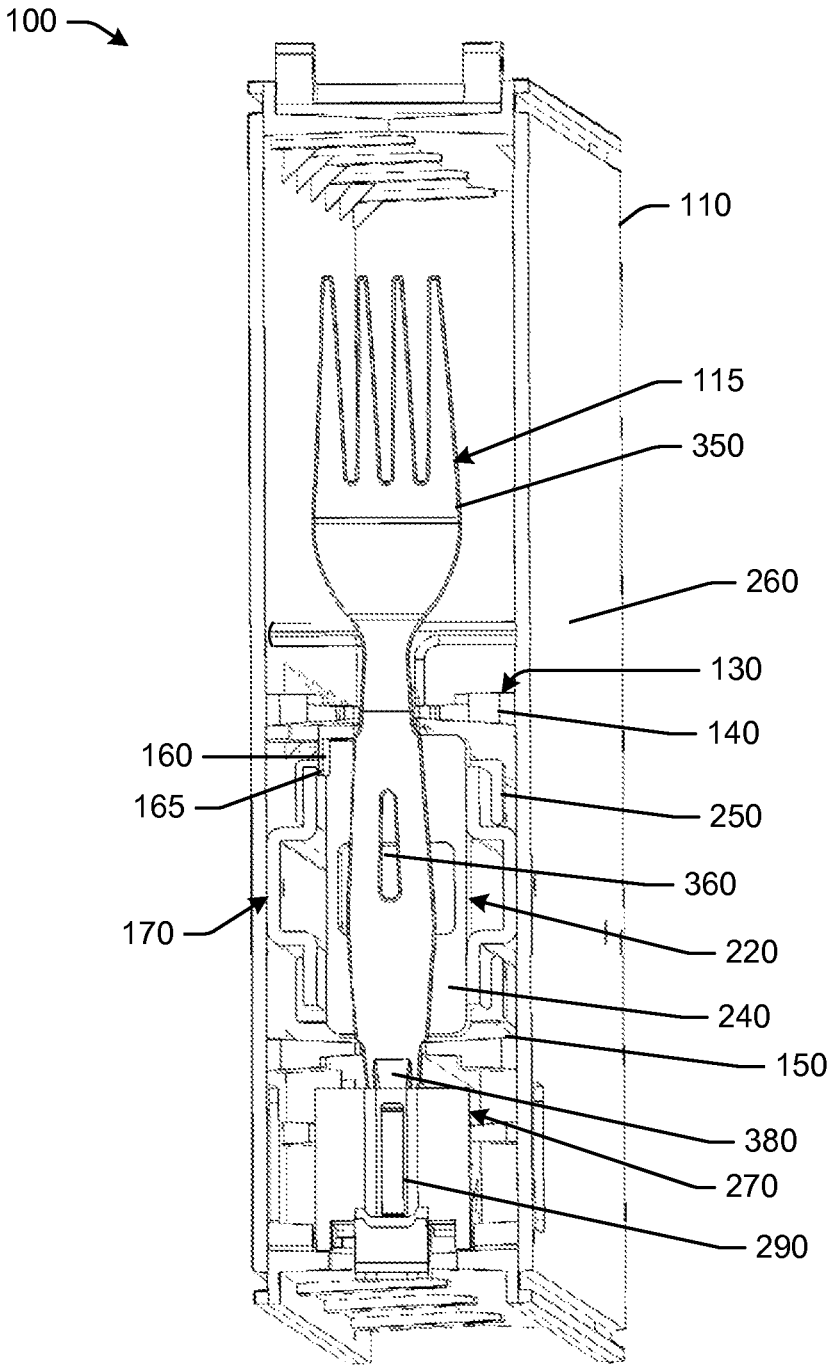
FIG. 2 is a front perspective view of the cutlery dispenser of FIG. 1 with the front cover removed.
Figure 3:
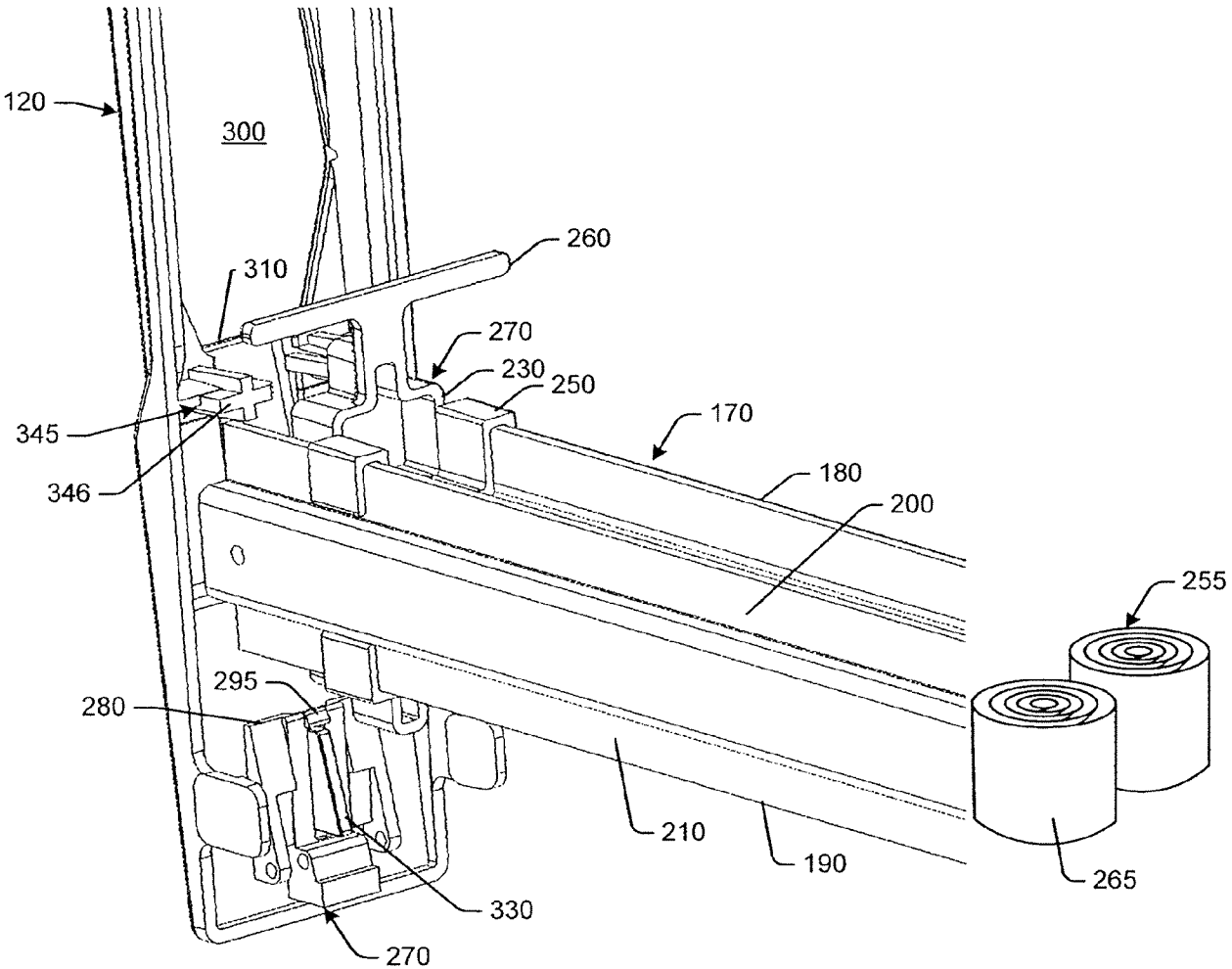
FIG. 3 is a partial perspective view of the pusher assembly and the front cover of the cutlery dispenser of FIG. 1.
Figure 4:
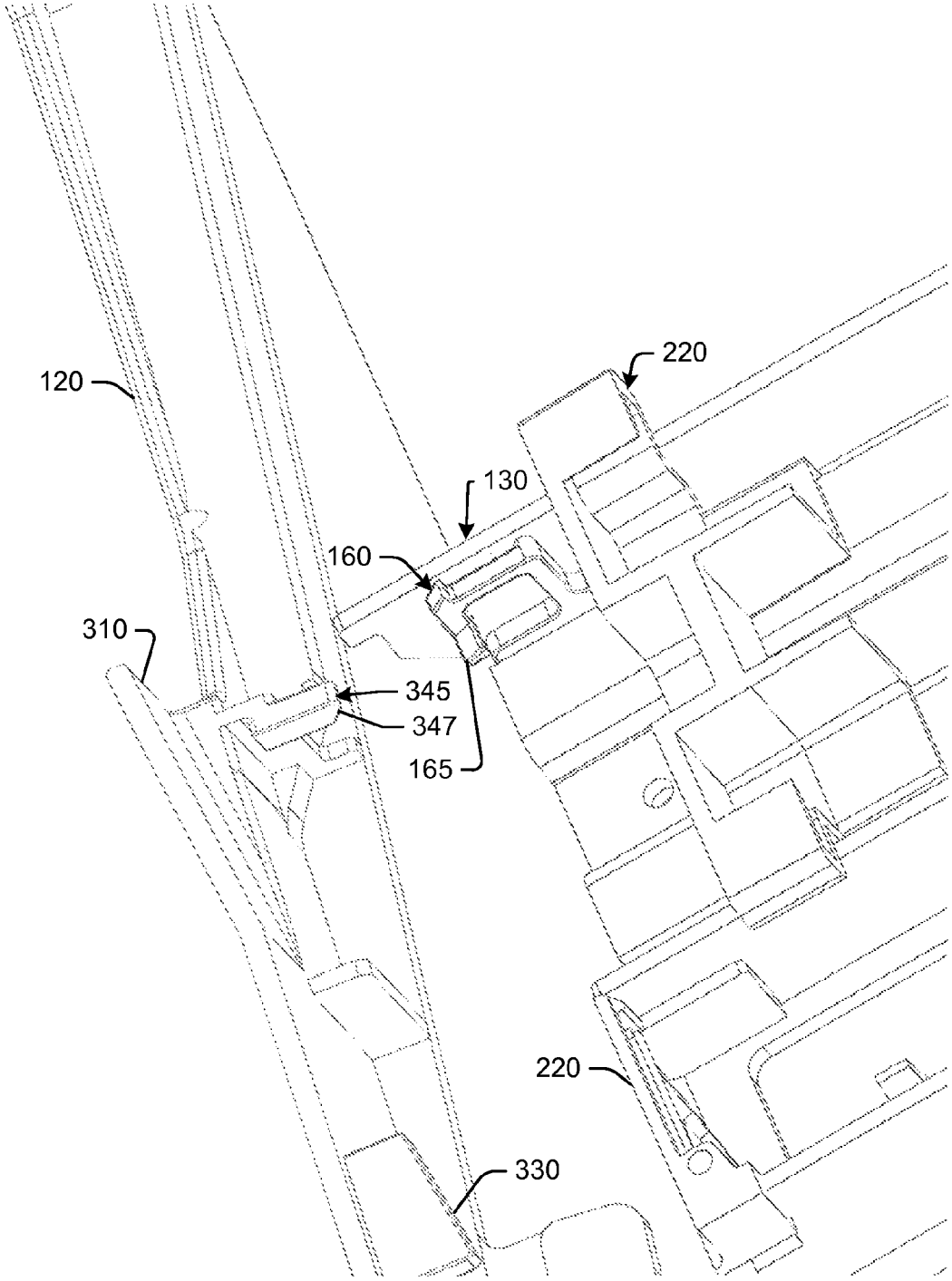
FIG. 4 is a partial perspective view of the flexors and the flexor spreaders of the cutlery dispenser of FIG. 1.

FIGS. 2-4 show an example of the internal components of the cutlery dispenser 110. Specifically, the housing 110 may have a number of guide ribs 130 formed or positioned on an inner wall thereof. In this example, a pair of upper guide ribs 140 and a pair of lower guide ribs 150 are shown. Any number of the guide ribs 130 may be used herein. Some or all of the guide ribs 130 may be positioned and/or sized and shaped to match a complimentary shaped utensil 115 such that only preferred utensils 115 of a specific size and shape may be used herein. The guide ribs 130 may have any suitable size, shape, or configuration. The guide ribs 130 may maintain the cutlery utensils 115 tracking towards the front cover 120 while also maintaining the substantially vertical position of the utensils 115.

At least the pair of upper guide ribs 140 may have a flexor 160 formed at the forward ends thereof. The flexors 160 may include a downwardly descending flange 165 intended to be in contact with the leading utensil 115 so as to hold the utensils 115 in place while loading, i.e., while the front cover 120 is open. The flexors 160 may have a degree of flexibility and memory as will be described in more detail below. As illustrated, the flexors 160 may maintain the cutlery utensils 115 in position adjacent to the front cover 120 or elsewhere until the front cover 120 is closed. Other components and other configurations may be used herein.

Positioned within the housing 110 adjacent to the guide ribs 130 may be a number of support tracks 170. In this example, a first support track 180 and a second support track 190 are shown. Any number of the support tracks 170 may be used. The support tracks 170 may be attached or otherwise positioned about the inner wall of the housing 110. Each of the support tracks 170 may include an upper flange 200 and a lower flange 210. The flanges 200, 210 may extend toward the guide ribs 130. The support tracks 170 may have any suitable size, shape, or configuration. Other components and other configurations may be used herein.

A pusher assembly 220 may be positioned on the support tracks 170 for movement therealong. The pusher assembly 220 may include a pusher element 230. The pusher element 230 may have a substantially flat abutment surface 240 and a number of pusher flanges 250. The pusher element 230 may have any suitable size, shape, or configuration. The pusher flanges 250 may be sized to accommodate the flanges 220, 210 of the support tracks 170 for movement thereon. The pusher assembly 220 also may include an upper pusher bar 260. The upper pusher bar 260 may be largely "T" shaped and also may be in contact with the upper portions of the last cutlery utensil 115. The ends of the upper pusher bar 260 may extend outside of the housing 110. If the ends do extend outside, the housing 110 may have a track therein for the ends to move along the length of the housing 110. The ends of the upper pusher bar 260 thus may act as a refill indicator and the like. Other types of refill or status indicators and/or structure may be used herein.

The pusher assembly 220 also may include at least one biasing member 255 or other type of advancement mechanism so as to drive the pusher element 230 towards the front cover 120 such that the cutlery utensils 115 may be dispensed therefrom. The biasing members 255 may include springs, rubber bands, magnets, and the like to push the pusher element 230. In this example, the biasing members 255 may be in the form of a pair of coil springs 265. Other types of mechanisms may be used herein so as to bias the pusher element 230 forward. Other components and other configurations may be used herein.

A retainer 270 may be positioned about the base of the housing 110 and adjacent to the front cover 120. The retainer 270 may be spring loaded so as to fold downward and allow the cutlery utensils 115 to be loaded therein and then spring back so as to maintain the utensils 115 in place. Other types of biasing mechanisms may be used herein. The retainer 270 may have a pair of retainer arms 280 defining a retainer aperture 290 therebetween. A retainer barb 295 may extend over the retainer aperture 290 or elsewhere and face inward within the housing 110. The retainer 270, and the components thereof, may have any suitable size, shape, or configuration. Other components and other configurations may be used herein.

FIGS. 1 and 3 show and example of the front cover 120. The front cover 120 may include a dispensing aperture 300. The dispensing aperture 300 may be sized and shaped to allow the cutlery utensils 115 to be grasped and removed one at a time therethrough. The dispensing aperture 300 may have an angled dispensing trough 310 at the bottom thereof. The angled dispensing trough 310 may be sized and angled for a single cutlery utensil 115 to rest therein for easy removal while preventing the removal of multiple utensils 115 at once. Specifically, the top of the angled dispensing trough 310 may have a depth of slightly more than one utensil 115 or so. Other components and other configurations may be used herein.

The front cover 120 may include a hinge 320. The hinge 320 allows the front cover 120 to rotate open and allows the cutlery utensils 115 to be loaded within the housing 110. Although the hinge 320 is shown as being on the top of the housing 110, the hinge 320 may be on the bottom and/or the sides.

As is shown in FIG. 3, the inside of the front cover 120 also may include a dispensing wedge 330 formed or positioned thereon. The dispensing wedge 330 may be sized to fit within the retainer aperture 290 between the retainer arms 280 of the retainer 270 when the front cover 120 is closed such that the dispensing wedge 280 may be in contact with the leading utensil 115 and push the leading utensil 115 into the dispensing trough 310 at an angle.

As is shown in FIGS. 3 and 4, the front cover 120 also may have a pair of flexor spreaders 345 formed or positioned thereon. The flexor spreaders 345 may be positioned adjacent to the dispensing aperture 300 such that the flexor spreaders 345 may align with the flexors 160 when the front cover 120 is closed. The flexor spreaders 345 may be block-like 346 (FIG. 3) or prong-like 347 (FIG. 4) so as to engage the downwardly descending flange 165 or other structure of the flexors 160 and spread the flexors 160 laterally or otherwise so as to release the cutlery utensils 115 from contact therewith. The flexor spreaders 345 may have any suitable size, shape, or configuration. Other types of spreading mechanisms may be used herein to release the flexors 160 from the utensils. Other components and other configurations also may be used herein.

Figure 5A:
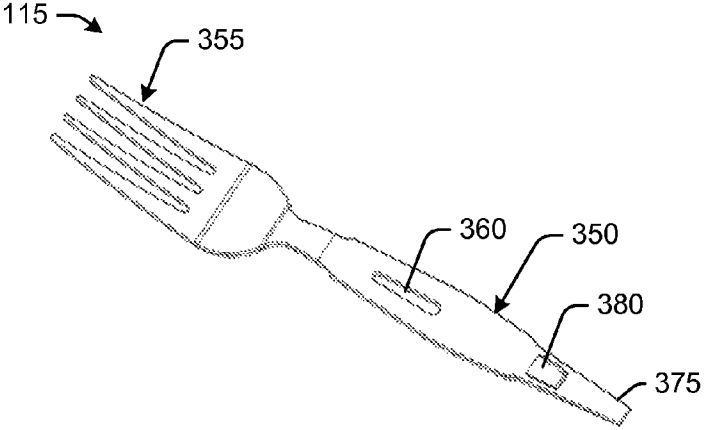
FIG. 5A is a perspective view of a fork that may be used with the cutlery dispenser of FIG. 1.
Figure 5B:
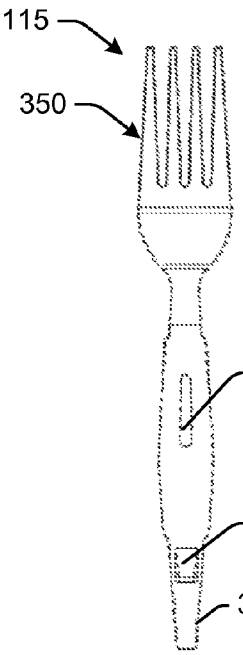
FIG. 5B is a front plan view of the fork of FIG. 5A.
Figure 5C:
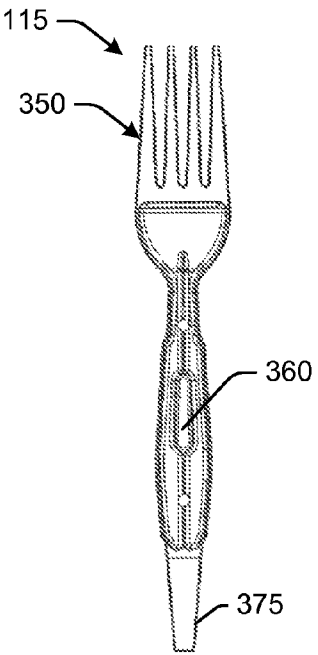
FIG. 5C is a back plan view of the fork of FIG. 5A.
Figure 5D:
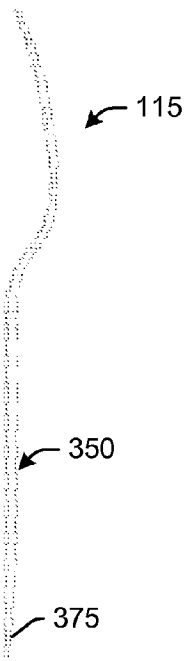
FIG. 5D is a right side plan view of the fork of FIG. 5A, the left side plan view being the same.
Figure 5E:
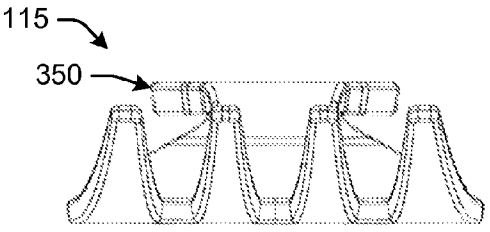
FIG. 5E is a top plan view of the fork of FIG. 5A.
Figure 5F:
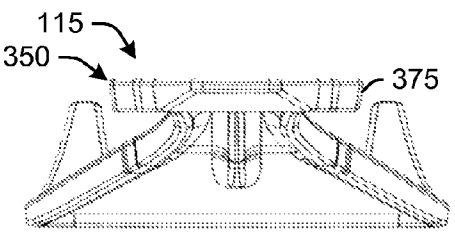
FIG. 5F is a bottom plan view of the fork of FIG. 5A.
Figure 5G:
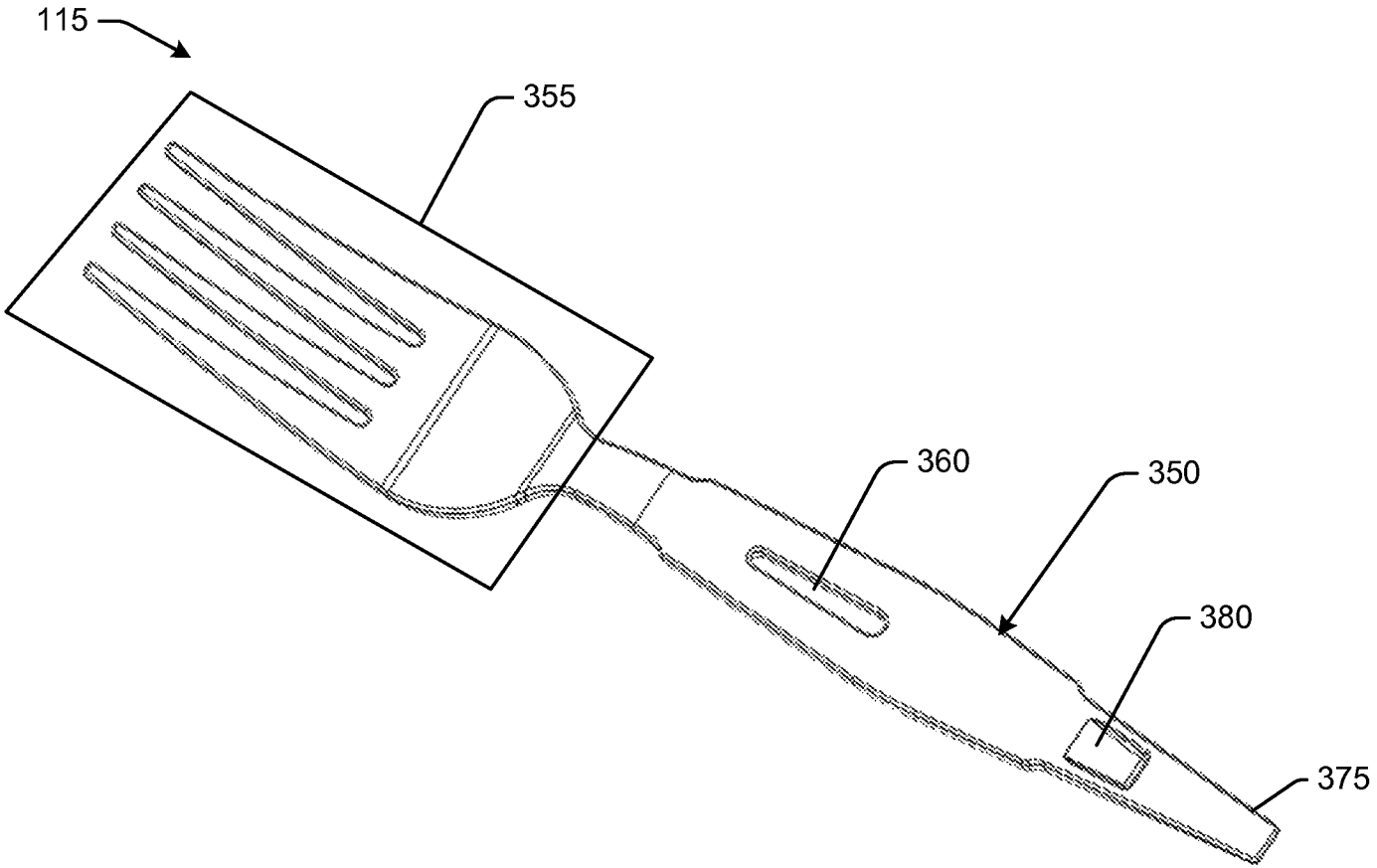
FIG. 5G is a perspective view of an alternative embodiment of a fork that may be used with the cutlery dispenser of FIG. 1.
Figure 6A:
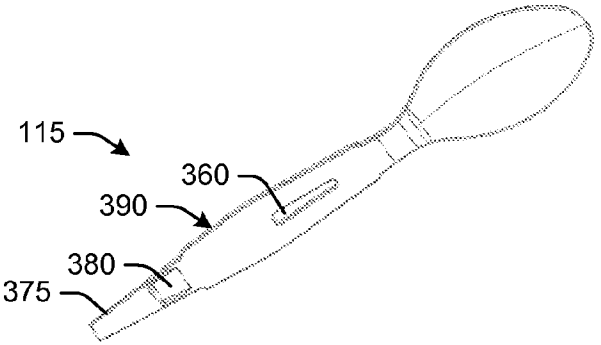
FIG. 6A is a perspective view of a spoon that may be used with the cutlery dispenser of FIG. 1.
Figure 6B:
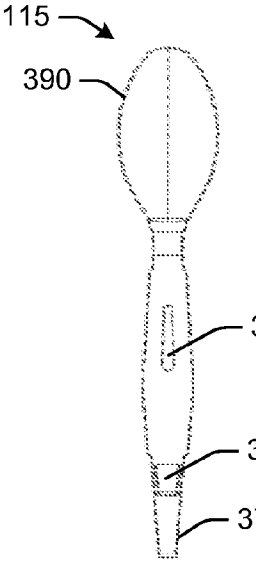
FIG. 6B is a front plan view of the spoon of FIG. 6A.
Figure 6C:
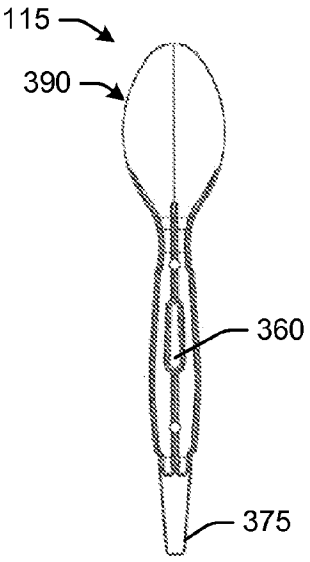
FIG. 6C is a rear plan view of the spoon of FIG. 6A.
Figure 6D:
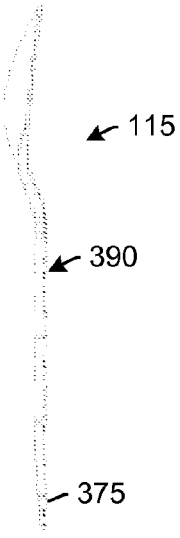
FIG. 6D is a right side plan view of the spoon of FIG. 6A, the left side plan view being the same.
Figure 6E:
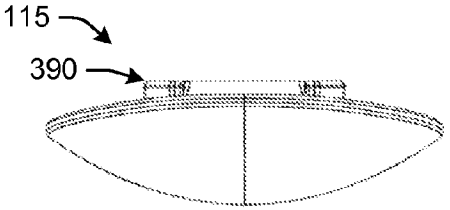
FIG. 6E is a top plan view of the spoon of FIG. 6A.
Figure 6F:
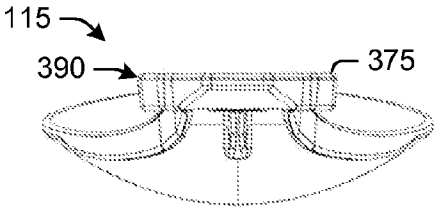
FIG. 6F is a bottom plan view of the spoon of FIG. 6A.
Figure 7A:
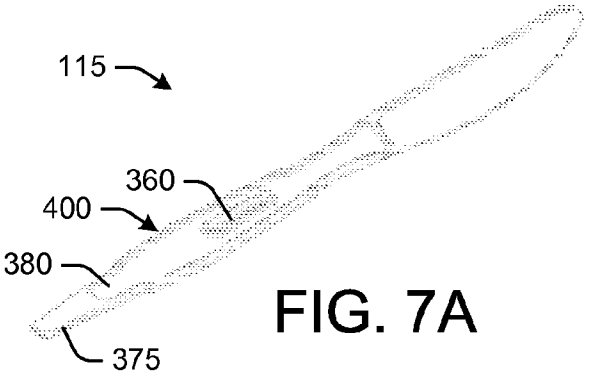
FIG. 7A is a perspective view of a knife that may be used with the cutlery dispenser of FIG. 1.
Figures 7B, 7C, 7D, 7E, 7F:
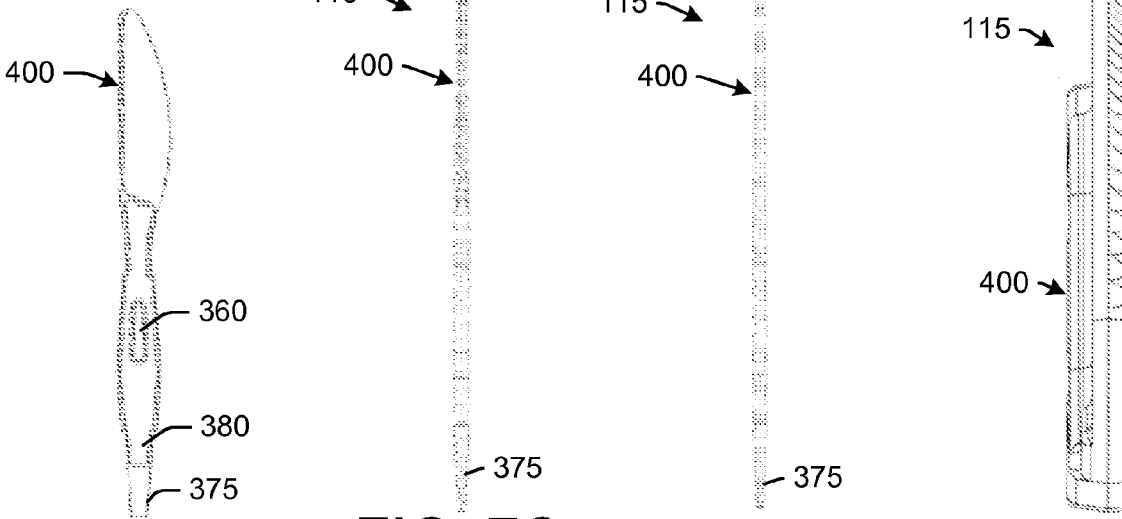
FIG. 7B is a front plan view of the knife of FIG. 7A, the rear plan view being the same.
FIG. 7C is a right side plan view of the knife of FIG. 7A.
FIG. 7D is a left side plan view of the knife of FIG. 7A.
FIG. 7E is a top plan view of the knife of FIG. 7A.
FIG. 7F is a bottom plan view of the knife of FIG. 7A.

FIGS. 5A-5F show an example of the cutlery utensil 115. In this example, the cutlery utensil 115 may be in the form of a fork 350. The fork 350 may have one or more skewer apertures 360 therein. The skewer apertures 360 may be sized and shaped for a skewer 370 or other type of joinder member or loading member to extend therethrough. The fork 350 also may have a retainer notch 380 formed therein. The retainer notch 380 may be sized to accommodate the retainer barb 295 of the retainer 270. The fork 350 also may have an angled end 375. The angled ends 375 allow the forks 350 to be fanned when placed together. The angled ends 375 may have any suitable angle depending in part on the desired distance between the tines of the fork 350 when placed together. As is shown in FIG. 5F, all or part of the fork 350 may be covered with a wrapper 355. In this example, just the tines of the fork 350 may be covered. The wrapper 355 may have any suitable size, shape, or configuration and may be made out of any suitable material such as thermoplastics, paper, and the like.

As is shown in FIGS. 6A-6F, a spoon 390 also may be used herein. Likewise as shown in FIGS. 7A-7F, a knife 400 may be used herein. A spork or any type of utensil 115 also may be used herein. The spoon 390, the fork 400, or other type of utensil 115 may include the skewer aperture 360, the angled end 375, and the retainer notch 380 therein. The wrapper 355 also may be used with any of the utensils 115. The utensils 115 may be sized for use with the cutlery dispenser 100. Combinations of different types of utensils 115 may be used herein together in any order, i.e., the cutlery dispenser 100 may dispense the fork 350, the spoon 390, and the knife 400 separately or in combination.

Figure 8:
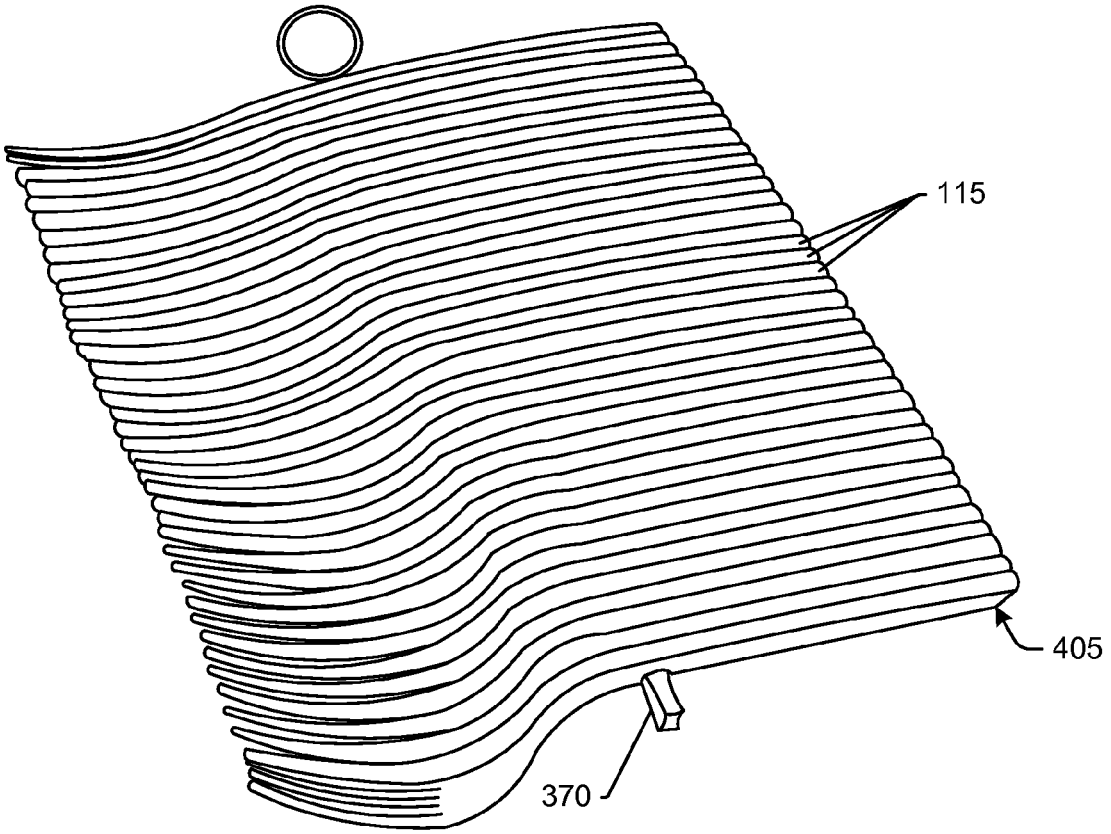
FIG. 8 is a perspective view of a stack of cutlery utensils that may be used with the cutlery dispenser of FIG. 1.

As is shown in FIG. 8, a stack 405 of the cutlery utensils 115 may be used herein. The stack 405 may be nested or otherwise oriented. The skewer 370 may extend through the skewer apertures 360. The skewer 370 may extend through the stack 405 for ease of transport and for ease of loading. The skewer 370 may be removed once the stack 405 is positioned within the housing 110. Other types of joinder members or other types of connection devices may be used herein to hold the stack 405 together. For example, shrink bands and the like may be used herein. Other components and other configurations may be used herein.

In use, the front cover 120 of the cutlery dispenser 100 may be opened and the stack 405 of the cutlery utensils 115 may be aligned along the guide ribs 130 and pushed therein. The retainer 270 may pivot downward until all of the utensils 115 have passed therethrough. The retainer 270 then may spring back into a substantially vertical position so as to maintain the utensils 115 in place adjacent to the front cover 120. Specifically, the retainer barb 295 of the retainer 270 may mate with the retainer notch 380 in the handle at the bottom of the leading utensil 115 while the flexors 160 contact the top of the leading utensil 115 for maintaining the utensils 115 firmly in place and in alignment. The skewer 370 then may be removed from the stack 405. Once the front cover 120 is closed, the cutlery dispenser 100 may be ready for "one-at-a-time" dispensing of the cutlery utensils 115 therein.

Figure 9:
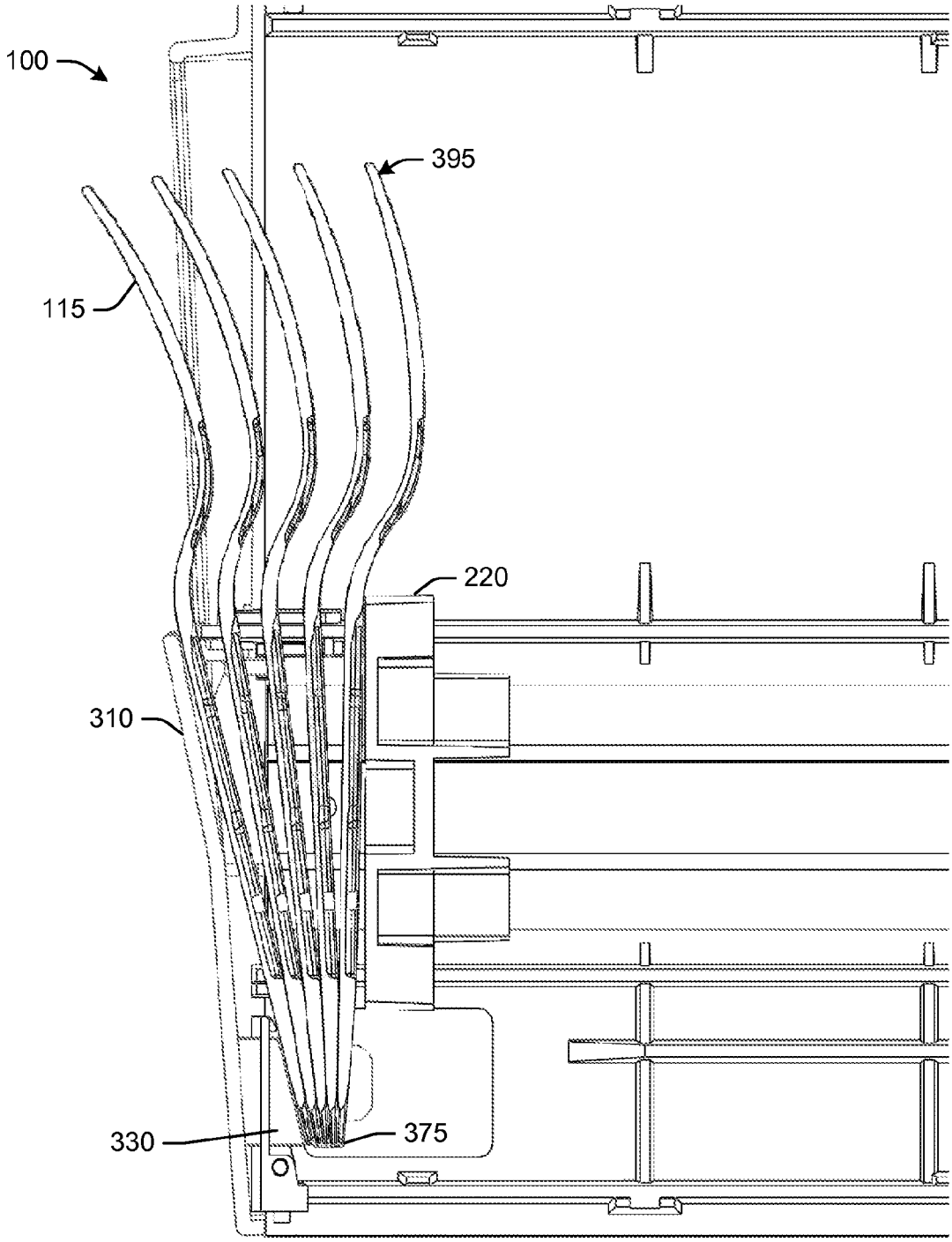
FIG. 9 is a side sectional view of the cutlery dispenser of FIG. 1 in a dispensing orientation.

The dispensing wedge 330 maneuvers through the retainer aperture 290 as the front cover 120 is closed. The dispensing wedge 330 thus comes into contact with the angled bottom 375 of the leading utensil 115 so as to push the leading utensil 115 out of engagement with the retainer bard 295. Likewise, the flexor spreaders 345 come into contact with the flexors 160 to push the flexors 160 out of engagement with the leading utensil 115. The first several utensils 115 thus are now free to assume a fanned position 395 as is shown in the dispensing orientation of FIG. 9. Specifically, the leading utensil 115 is now free for dispensing through the dispensing trough 310 at an angle. The extent of the fanned position 395 may depend, in part, on the nature and angle of the dispensing trough 310, the dispensing wedge 330, and/or the angled bottoms 375. The fanned position 395 also promotes, in combination with the wrapper 355, the appearance of cleanliness in that the utensils 115 are separated from each other during dispensing. The pusher assembly 270 pushes the utensils 115 forward as each one is removed. Of interest is the fact that the cutlery dispenser 100 described herein may operate in any orientation given that the dispenser does not rely on gravity to dispense. Other components and other configurations may be used herein.

Figure 10:
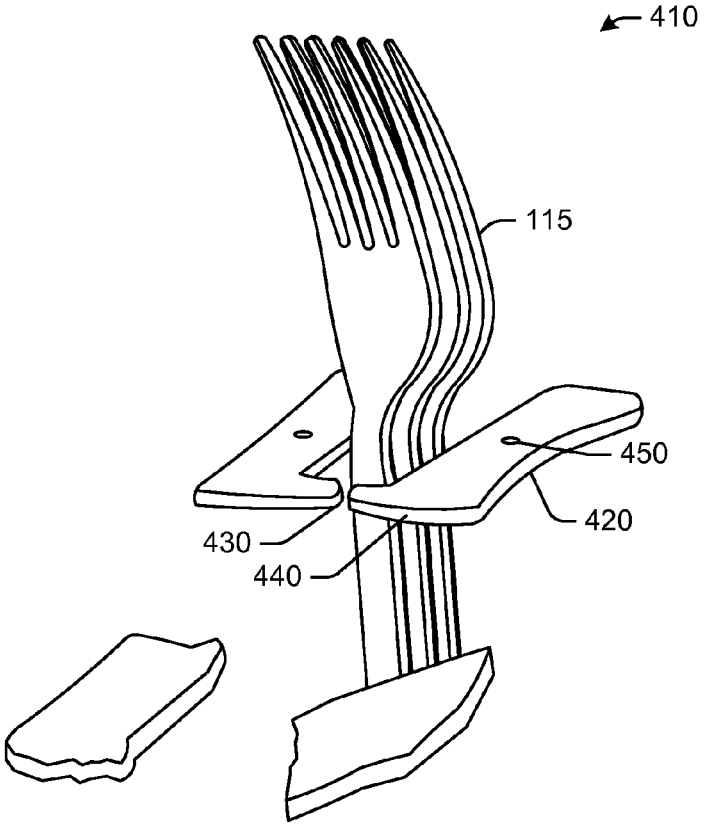
FIG. 10 is a perspective view of an alternative embodiment of a cutlery dispenser as may be described herein with a pair of pivot arms.
Figure 11:
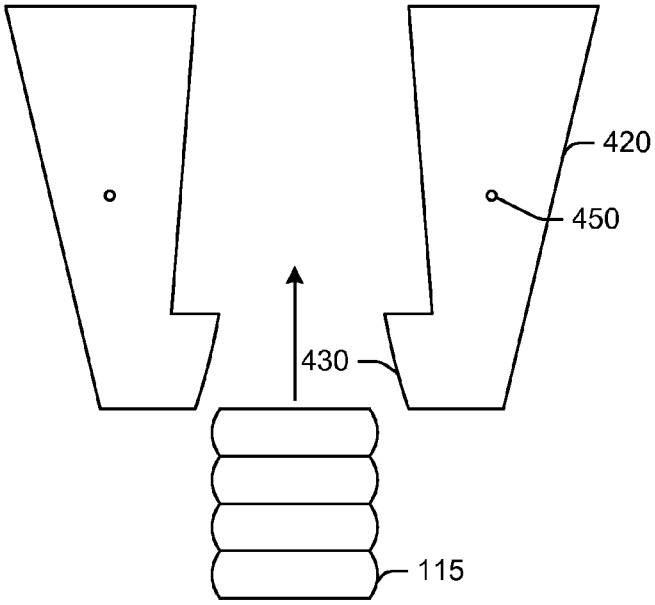
FIG. 11 is a top plan view of the pair of pivot arms of the cutlery dispenser of FIG. 7.

FIGS. 10 and 11 show an alternative embodiment of a cutlery dispenser 410 as may be described herein. Instead of using the flexors 160 on the guide ribs 130, the cutlery dispenser 410 may include a number of pivot arms 420 to maintain the stack 405 in place. The pivot arms 420 may be spring loaded or otherwise biased. The pivot arms 420 may have a barb 430 on one end thereof. The barbs 430 may have a lead-in surface 440 at an end thereof. The pivot arms 420 may pivot about a pivot point 450. Other types of flexors 160 may be used herein. Other components and other configurations may be used herein.

In use, the stack 405 may be pushed through the pivot arms 420 via the lead-in surface 440 on the barbs 430. The barbs 430 then may close to maintain the stack 405 in place. One the front cover 120 is closed, the flexor spreaders 345 may open the pivot arms 420 such the utensils 115 may be dispensed in a manner similar to that described above. Other types of biasing means may be used herein. Other components and other configurations also may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

What is claimed is:

1. A cutlery dispenser for dispensing a number of cutlery utensils, comprising:

a housing;

a front cover enclosing the housing;

the front cover comprising a first end and a second end;

a dispensing aperture positioned about the first end of the front cover;

a dispensing wedge positioned about the second end of the front cover; and an angled dispensing trough positioned on the front cover between the dispensing aperture and the dispensing wedge;

wherein the dispensing wedge angles a leading cutlery utensil into the angled dispensing trough for dispensing therethrough.

2. The cutlery dispenser of claim 1, wherein the housing comprises a plurality of guide ribs formed or positioned therein.

3. The cutlery dispenser of claim 2, wherein the plurality of guide ribs conforms at least in part to the configuration of the number of cutlery utensils.

4. The cutlery dispenser of claim 1, further comprising a pusher assembly positioned within the housing so as to advance the number of cutlery utensils towards the front cover.

5. The cutlery dispenser of claim 4, wherein the housing comprises a plurality of support tracks and wherein the pusher assembly is positioned about the plurality of support tracks for movement thereon.

6. The cutlery dispenser of claim 4, wherein the pusher assembly comprises an abutment surface intended for contact with a stack of the number of cutlery utensils.

7. The cutlery dispenser of claim 4, wherein the pusher assembly comprises a biasing member.

8. A cutlery dispenser for dispensing a number of cutlery utensils, comprising:

a housing;

a front cover enclosing the housing;

a dispensing wedge; and an angled dispensing trough positioned on the front cover;

wherein the dispensing wedge angles a leading cutlery utensil into the angled dispensing trough for dispensing therethrough; and wherein the housing comprises a plurality of flexors formed or positioned therein.

9. The cutlery dispenser of claim 8, wherein the plurality of flexors comprises a downwardly descending flange.

10. The cutlery dispenser of claim 8, wherein the plurality of flexors comprises a pivot arm.

11. A cutlery dispenser for dispensing a number of cutlery utensils, comprising:

a housing;

a front cover enclosing the housing;

a dispensing wedge;

a dispensing trough positioned on the front cover;

wherein the dispensing wedge angles a leading cutlery utensil into the dispensing trough for dispensing therethrough; and wherein the housing comprises a spring loaded retainer positioned about the front cover.

12. The cutlery dispenser of claim 11, wherein the spring loaded retainer comprises a retainer aperture sized for the dispensing wedge to pass therethrough when the front cover is closed.

13. The cutlery dispenser of claim 11, wherein the spring loaded retainer comprises a retainer barb extending into the housing and intended for contact with the leading cutlery utensil when the front cover is open.

14. A method of dispensing cutlery utensils from a dispenser, comprising:

pushing a stack of cutlery utensils into the dispenser;

holding the stack of cutlery utensils in place via a pair of flexors when a front cover of the dispenser is open;

closing the front cover;

releasing the pair of flexors when the front cover is closed; and pushing several of the cutlery utensils into a fanned position about the front cover.

15. A cutlery dispenser, comprising:

a housing;

a front cover enclosing the housing;

a dispensing wedge positioned about the front cover; and a stack of cutlery utensils positioned within the housing;

a plurality of the cutlery utensils in the stack comprising a fanned position about the front cover; and wherein the housing comprises a retainer with a retainer barb and wherein the plurality of cutlery utensils comprises a retainer notch formed therein.

16. The cutlery dispenser of claim 15, wherein the plurality of cutlery utensils comprises a skewer aperture therein sized for a skewer.

17. The cutlery dispenser of claim 15, wherein the plurality of cutlery utensils comprises an angled end.

* * * * *